US006805642B2

(12) United States Patent
Meyer

(10) Patent No.: US 6,805,642 B2
(45) Date of Patent: Oct. 19, 2004

(54) HYBRID GOLF CLUB SHAFT

(75) Inventor: Jeffrey W. Meyer, Fallbrook, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/292,010

(22) Filed: Nov. 12, 2002

(65) Prior Publication Data

US 2004/0092329 A1 May 13, 2004

(51) Int. Cl.[7] ..... A63B 53/12
(52) U.S. Cl. ..... 473/320; 473/321; 473/323
(58) Field of Search ..... 473/314, 320, 473/321, 323

(56) References Cited

U.S. PATENT DOCUMENTS

| | | | | | |
|---|---|---|---|---|---|
| 4,084,819 | A | | 4/1978 | Van Auken | 273/80 R |
| 4,097,626 | A | * | 6/1978 | Tennent | 428/36.4 |
| 4,188,032 | A | * | 2/1980 | Yanagioka | 473/320 |
| 4,539,253 | A | * | 9/1985 | Hirschbuehler et al. | 442/239 |
| 4,961,576 | A | * | 10/1990 | Meredith | 473/323 |
| 5,028,464 | A | | 7/1991 | Shigetoh | 428/35.9 |
| 5,083,780 | A | | 1/1992 | Walton et al. | 273/80 B |
| 5,259,614 | A | | 11/1993 | Greer | 273/80 B |
| 5,324,032 | A | | 6/1994 | Minami | 273/80 B |
| 5,427,373 | A | * | 6/1995 | Kusumoto | 473/319 |
| 5,437,450 | A | * | 8/1995 | Akatsuka et al. | 473/320 |
| 5,599,242 | A | * | 2/1997 | Solviche et al. | 473/318 |
| 5,607,364 | A | * | 3/1997 | Hedrick et al. | 473/318 |
| 5,755,826 | A | | 5/1998 | Beach et al. | 473/316 |
| 5,773,154 | A | | 6/1998 | Takada | 428/458 |
| 5,904,628 | A | | 5/1999 | MacKay, Jr. et al. | 473/326 |
| 5,924,936 | A | * | 7/1999 | Penley | 473/289 |
| 6,139,444 | A | * | 10/2000 | Renard et al. | 473/320 |
| 6,287,696 | B1 | * | 9/2001 | Noda et al. | 428/411.1 |
| 6,302,806 | B1 | | 10/2001 | Hsu | 473/320 |
| 2002/0119829 | A1 | * | 8/2002 | Cheng | 473/316 |

FOREIGN PATENT DOCUMENTS

| | | | |
|---|---|---|---|
| GB | 2227418 | * | 1/1990 |
| JP | 2001-246029 | * | 9/2001 |
| JP | 2002-126142 | * | 5/2002 |
| JP | 2002126142 | | 8/2002 |
| JP | 2002-253714 | * | 9/2002 |
| WO | WO 01/97990 | | 12/2001 |

* cited by examiner

*Primary Examiner*—Stephen Blau

(57) ABSTRACT

A hollow golf club shaft of circular cross-section comprises a tubular cover layer formed from an isotropic material and a tubular core layer formed from a non-isotropic material, wherein the cover layer and the core layer coextend substantially the entire length of the shaft.

20 Claims, 5 Drawing Sheets

HYBRID GOLF CLUB SHAFT

FIELD OF THE INVENTION

This invention relates generally to golf clubs and, more particularly, to a hybrid shaft for improving the performance of golf clubs.

BACKGROUND OF THE INVENTION

A modern golf club typically comprises a shaft, a head connected to the shaft's tip end, and a grip disposed at the shaft's butt end. Perhaps more than any other component, the shaft affects overall club performance. It is generally accepted that the optimal golf club shaft should have lightweight, high torsional stiffness, configurable bending stiffness, and provide moderately high swing weight and vibration-damping property.

A lightweight club generates greater acceleration, which in turn yields a higher swing velocity, than a heavy club does for the same amount of applied force. For clubs of similar weight and mass distribution, the greater the swing velocity, the farther the ball will travel when driven by the clubs. Torsional stiffness is preferred to limit unwanted angular deflection of the head about the shaft. This allows the face of the club head to impact the ball squarely so that the ball's flight will follow a straight path. The torsional stiffness may be enhanced by enlarging the shaft's diameter to increase polar moment of inertia, as well as by using materials having high Young's modulus such as steel.

Skilled golfers who generate high swing velocity prefer clubs having a high bending stiffness. Average golfers, on the other hand, like clubs with low bending stiffness to take advantage of the "kick" resulting from shaft flexing during early part of swing and subsequent release as the golf club head impacts the ball. But golfers of all levels want a set of clubs having essentially the same swing weights to achieve consistent play. Swing weight is a measure of how the mass is distributed on a club and equates to the dynamic characteristics or "feel" of the club. Tip-weighted shafts and/or heavy club heads tend to increase the clubs' swing weights, while butt-weighted shafts and/or light club heads tend to decrease the clubs' swing weights. A desirable club should also incorporate vibration-damping materials to absorb tactile shock and reduce acoustic propagation caused by the head striking the ball and/or ground.

There are essentially three existing club shaft designs, including metal shafts, composite shafts, and hybrid shaft of metal and composite material. Conventional shafts often optimize some of the characteristics mentioned above while compromising others.

The metal shaft, typically formed from steel, has long been the mainstay of golf club design. Steel has a high shear modulus, giving the shafts an inherently high torsional stiffness. Shafts of various bending stiffness and swing weights can be obtained by manipulating the thickness and lengths of the flexible tip portion and the rigid butt portion. Steel is also durable, strong, inexpensive, and provides great consistency of characteristics from one shaft to another. Unfortunately, steel is dense, and clubs having steel shafts are heavy, have relatively poor acceleration and consequently a lower swing velocity. Additionally, The conventional heavy rubber grip used with the steel shaft, comprising about 15% or more of the total mass of a typical driver or any fairway woods, further compounds the weight and weight distribution problems. Steel shafts are also very poor in absorbing shocks or damping vibrations.

Club shafts comprising composite materials such as graphite are commonly preferred over steel shafts because they can be made extremely lightweight and conform to desired flexural characteristics. The light graphite shaft affords the club with high swing velocity, which produces long drives. Primary drawbacks of the composite graphite designs are their high bending stiffness and low torsional stiffness. To provide a composite shaft with the same torsional stiffness as a metal shaft, particularly in the tip end where the torsional stress is great, many plies of high modulus fibers oriented at ±45 degree angle to the longitudinal axis of the shaft must be incorporated. Unfortunately, these fibers add significant bulk and weight in a particularly undesirable location on the shaft. Additionally, graphite composite shafts are more likely to break, particularly at the tip portion, the part of the shaft with the smallest diameter. Nonetheless, most golfers prefer composite shafts because they are lightweight and have a more pleasant "feel" at impact than steel shafts. Composite shafts are also less sensitive to resonance phenomena since graphite composites are good vibration damping materials.

Hybrid shaft designs typically incorporate both metal and composite materials. U.S. Pat. Nos. 4,836,545 and 5,253,867 both disclose two-piece hybrid shafts that join together a lower metal tip portion with an upper composite butt portion. U.S. Pat. No. 5,028,464 discloses a golf club shaft having a laminated composite tube on the inside, a resin coat on the outside, and a transparent metallic layer disposed between the laminated tube and the resin coat. The transparent metallic layer is formed by depositing or plating a very thin layer of a metallic element onto a transparent cloth of organic and/or organic fibers impregnated with a thermosetting or thermoplastic resin. U.S. Pat. No. 5,083,780 discloses a tubular metal shaft having a short shell of reinforced composite molded over a predetermined location on the metal shaft to control the bending point of the shaft. U.S. Pat. No. 5,259,614 discloses a golf club shaft having a hollow steel tubular core and a composite filament spirally wound about the core to form a seamless jacket thereabout. U.S. Pat. No. 5,607,364 discloses a golf club shaft including a damping layer coated to the inner diameter of the shaft, and the damping layer is formed from a viscoelastic material. U.S. Pat. No. 5,904,628 discloses, among others, a lightweight hollow metal golf club shaft with an inflatable and flexible bladder which is pressurized by a gas to rigidify, reinforce and enhance the performance of the shaft. U.S. Pat. No. 6,139,444 discloses a hollow composite shaft having a preformed sheath metal tube surround the tip portion of the composite shaft as an external stiffener. U.S. Pat. No. 6,302,806 discloses a composite shaft having steel filaments aligned longitudinally in the tip portion for weighting, and steel filaments aligned longitudinally in the butt portion for reinforcement, thereby adjusting center of gravity and bending point of the shaft. U.S. patent application Ser. No. 09/248,569 discloses a hybrid shaft having a steel tip portion and a composite butt portion joined together, and the steel tip has a vibration damping member embedded therein. U.S. patent application Ser. No. 09/813,608 discloses a steel golf shaft having a steel tip portion and a steel butt portion joined by a composite pivot portion via connectors of various configurations.

There remains a need, however, for an improved golf club shaft that is light weight and provides the improved feel and vibration damping of fiber/resin composite shafts, as well as increased torsional stiffness and resistance to breakage of metal shafts.

SUMMARY OF THE INVENTION

The present invention is directed to a hollow golf club shaft of circular cross section having a tubular cover layer and a tubular core layer. The cover layer and the core layer are conjoined and coextend substantially the entire length of the shaft. Preferably, the cover layer has a thickness of less than about 0.2 inches, and the core layer has a thickness of less than about 0.3 inches. The cover layer is formed from an isotropic material such as metal matrix composites, metals and alloys thereof, including titanium, steel, stainless steel, aluminum, tungsten, nickel, copper, zinc, brass, bronze, magnesium, tin, gold, or silver. Preferably, the cover layer is a solid, continuous and non-porous metallic sheath.

The core layer is formed from a non-isotropic material, such as a reinforcement material, preferably impregnated with a vibration damping thermosetting or thermoplastic resin. Suitable reinforcement material include carbon fibers, graphite fibers, glass fibers, quartz fibers, boron fibers, ceramic fibers, ceramic whiskers, metal-coated fibers, ceramic-coated fibers, diamond-coated fibers, carbon nanotubes, extended-chain polyethylenes, poly-p-phenylenebenzobisoxazole fibers, metal fibers, polythenes, polyarylates, polyacetals, liquid crystalline polymers, aromatic polyesters, or polyallylates. Suitable resins include epoxy, polyester, polystyrene, polyurethane, polyurea, polycarbonate, polyamide, polyimide, polyethylene, polypropylene, polyether, polyvinyl halide, polyvinylidene halide, nylon, nylon 6, polyphenylene sulfide, polyether ether ketone, polyether ketone ketone, polyamide imide, polyether imide, polyaryl sulfone, polyether sulfone, or liquid crystal polymer. Preferably, substantially all of the reinforcement material is aligned longitudinally along the shaft. The thermosetting or thermoplastic resin has a loss factor of between about 0.2 and about 1.2 at 100 Hz and 68° F., a shear storage modulus of at least about 1,000 psi, and a Young's modulus of at least about 0.01 Mpsi. In one embodiment, the non-isotropic material is epoxy-impregnated carbon or graphite fibers, and the carbon or graphite fibers are present in an amount of from about 10% to about 80% by volume of the non-isotropic material.

Preferably, the shaft has a total weight of less than about 130 grams, the cover layer has a weight of less than about 80 grams, and the core layer has a weight of less than about 100 grams. The shaft may further have a vibration damping layer formed of at least one viscoelastic material disposed between the core layer and the cover layer, wherein the vibration damping layer comprises. Preferably, the viscoelastic material has a Young's modulus of at least about 15 psi, a shear storage modulus of at least about 10 psi, a strain energy ratio of at least about 2%, and a loss factor of at least about 0.01 at a temperature range of −40° C. to 100° C. and a frequency range of 1 Hz to 10,000 Hz. More preferably, the vibration damping thermosetting or thermoplastic resin in the core layer is substantially the same as the viscoelastic material. The vibration damping layer preferably has a thickness of less than about 0.1 inches, covers at least about 5% of the shaft length, and can be a continuous layer, a discontinuous layer, a layer of uniformed thickness, a layer of non-uniformed thickness, a lattice network layer, a wound layer, a woven layer, a braided layer, or a laminar layer. The shaft may further comprises a reinforcing layer embedded in or disposed on an inner surface of the core layer, having a length of at least about 5% of the shaft length.

The invention is also directed to a hollow golf club shaft of circular cross section comprised of a tubular cover layer formed from an isotropic material having a Young's modulus of at least about 5 Mpsi, and a tubular core layer formed from a non-isotropic material. Preferably, the cover layer and the core layer are conjoined and coextend substantially the entire length of the shaft. The non-isotropic material of the core layer includes a reinforcement material and a thermosetting or thermoplastic resin. The resin preferably has a Young's modulus less than the isotropic material of the cover layer by at least about one order of magnitude. The cover layer has a thickness ranging from about 0.001 inches to about 0.15 inches, and the core layer has a thickness ranging from about 0.001 inches to about 0.2 inches. The shaft may further include a vibration damping layer between the cover layer and the core layer having a thickness ranging from about 0.0005 inches to about 0.05 inches, and/or a reinforcing layer embedded in or disposed on an inner surface of the core layer having a thickness of less than about 0.1 inches.

The invention is further directed to a hollow golf club shaft of circular cross section having a tubular cover layer formed from an isotropic material and a tubular core layer formed from a non-isotropic material, wherein the cover layer and the core layer are conjoined and coextend substantially the entire length of the shaft, and a volume ratio of the core layer to the cover layer is less than about 20:1. Any one location along the shaft preferably has a thickness ratio of the cover layer to the core layer ranging from about 5:95 to about 90:10. The outer surface of the core layer can be conjoined to the inner surface of the cover layer through structural adhesives, contact adhesion, physical bonding, or chemical bonding. Preferably, the structural adhesives is one-part heat-cured epoxies, two-part reaction-cured epoxies, two-part reaction-cured polyurethanes, acrylics, double-coated bonding tapes, pressure-sensitive adhesives, or heat-cured epoxy/acrylic hybrid adhesives.

DEFINITIONS

As used herein, the term "Young's modulus," also known as "elastic modulus" and "tensile modulus," is a measurement of a material's stiffness and is defined as the ratio of stress to strain Young's modulus can be used to predict the elongation or compression of an object as long as the stress is less than the yield strength of the material.

As used herein, the term "isotropic" refers to a material with properties such as stiffness that remain the same independent of the loading direction or the plane on which the load is applied. Such materials have only 2 independent variables (i.e. elastic constants) in their stiffness and compliance matrices. The two elastic constants are usually expressed as the Young's modulus E and the Poisson's ratio v. However, alternative elastic constants K (bulk modulus) and/or G (shear modulus) can also be used.

Intuitively, the term "non-isotropic" used herein refers to a material that is not isotropic. A non-isotropic material may be "anisotropic," which denotes a material having certain properties that are different in different directions, or "quasi-isotropic," which refers to a condition wherein properties are nearly identical in all directions. Particularly in fiber-reinforced composites, quasi-isotropic condition can be attained by providing at least three directions with reinforcement in similar layer thickness.

As used herein, the term "loss factor" represents a measure of the energy dissipation of the vibration damping material and depends on the frequency and temperature experienced by the material.

As used herein, the term "shear storage modulus," also known as "storage modulus," is denoted as G' and refers to the ratio of shear stress to strain (deformation) when dynamic (sinusoidal) deformation is applied in a cone-and-plate rheometer. It relates to the elastic energy stored in a viscoelastic material and released periodically. Loss modulus, G", also determined in dynamic (sinusoidal) measurements, relates to the material's viscous behavior. G' and G" together give an idea of the dual nature of the viscoelastic material (partly elastic solid and partly viscous fluid). Measurements of G' and G" provide information on polymer structure and might be related to molecular weight distribution, cross-linking, etc.

As used herein, the term "strain energy ratio" refers to the ratio of elastic strain energy in a viscoelastic material to the total strain energy in the material.

DETAILED DESCRIPTION OF THE INVENTION

Referring now to the figures, a discussion of the above features with respect to preferred embodiments is provided below. It should be understood that such embodiments are for illustrative purposes, and should not be construed as limiting the scope of the invention.

Figure 1:
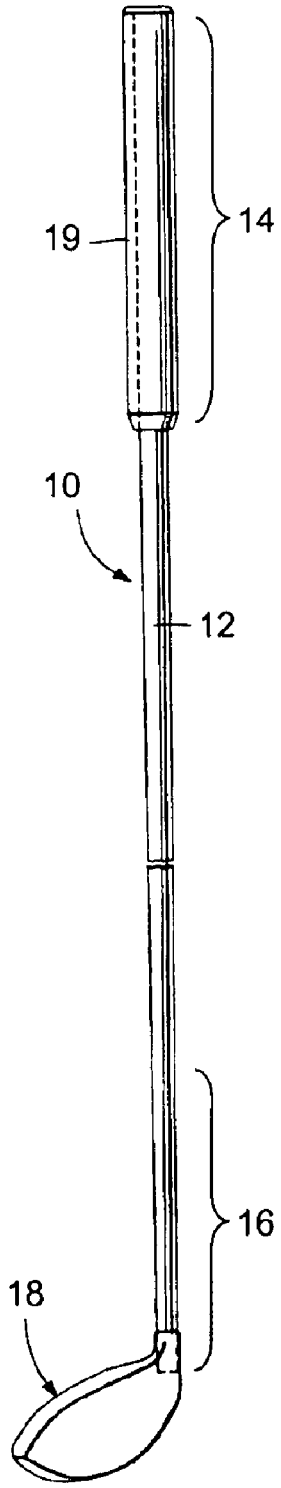
FIG. 1 is a perspective view of a golf club having a multi-layer shaft in accordance with the present invention.

FIG. 1 shows a golf club 10 that comprises a tubular multi-layer shaft 12 of the present invention. The shaft 12 substantially tapers downward through its entire length from an upper (larger diameter) butt portion 14 to a lower (smaller diameter) tip portion 16. A club head 18 is attached to the end of the tip portion 16, and an optional grip 19 is attached to the butt portion 14. The tip portion 16 (typically less than about ⅓ the entire length of the shaft 12) and/or the butt portion 14 (typically less than about ⅓ the entire length of the shaft 12) can be tapered or parallel.

Figure 2:
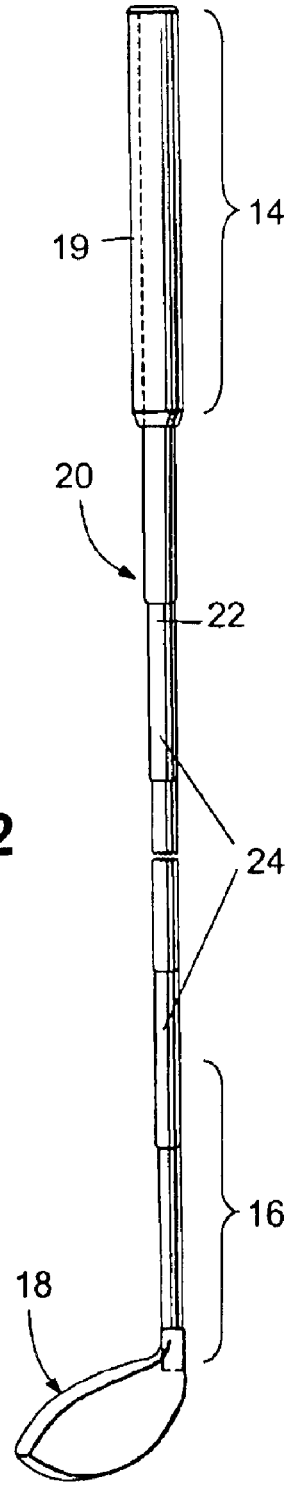
FIG. 2 is a perspective view of another golf club having an alternative multi-layer shaft in accordance with the present invention.

An alternative multi-layer shaft 20, as depicted in FIG. 2, has a stepped-down shaft 20 with the club head 18 attached to its tip portion 16 and the optional grip 19 attached to its butt portion 14. The shaft 22 is assembled from a plurality of tubular portions 24 having decreasing diameters. Each of the tubular portions 24 can independently be either substantially tapered or substantially parallel. Of course, the present invention is also applicable to shafts that are substantially parallel throughout their entire lengths. That is, butt portion 14 and tip portion 16 and any portion therebetween have about the same outer diameter. The butt portion 14 has an outer diameter of between about 0.5 inches and about 0.9 inches, while the tip portion 16 has an outer diameter of between about 0.2 inches and about 0.6 inches. The shafts 12 and 22 typically have a length of about 30 inches to about 65 inches.

Figure 3:
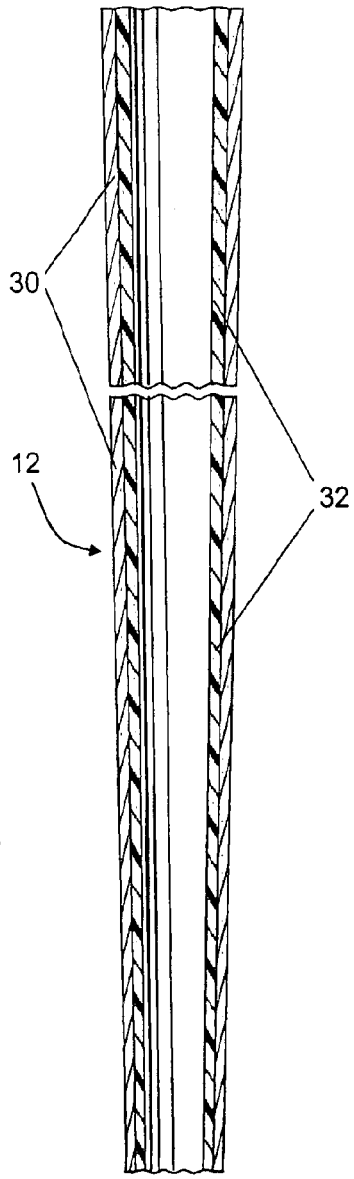
FIG. 3 is a longitudinal sectional view of the multi-layer golf shaft of FIG. 1.
Figure 4:
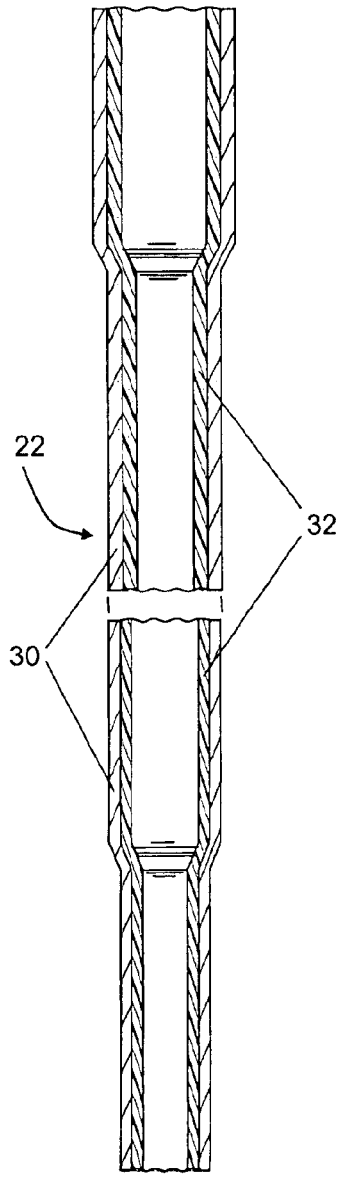
FIG. 4 is a longitudinal sectional view of the multi-layer golf shaft of FIG. 2.

FIGS. 3 and 4 illustrate the longitudinal sectional views of shafts 12 and 22 in FIGS. 1 and 2, respectively. Shaft 12 has a tubular cover layer 30 and a tubular core layer 32, both coextensive substantially the entire length of the shaft 12. Similarly, shaft 22 also includes cover layer 30 and core layer 32. For simplicity reasons, the following descriptions use shaft 12 as the example. A person of ordinary skill in the art can readily apply the same compositions, dimensions, and configurations for shaft 12 in the production of shaft 22.

Referring to FIG. 3, cover layer 30 may be a continuous layer formed from at least one isotropic material having a Young's modulus of preferably greater than about 5 Mpsi, and more preferably greater than about 10 Mpsi. The isotropic material may be a metallic material such as metal matrix composites, metals, or alloys thereof including one or more combinations of metallic constituents. Among the numerous metals that are suitable for cover layer 30, ferrous metals such as titanium, steel, stainless steel, aluminum and tungsten are particularly useful. Additionally, certain non-ferrous metals including nickel, copper, zinc, brass, bronze, magnesium, tin, gold and silver may be employed generally as alloying agents. Metal matrix composites that are quasi-isotropic may also be desirable for use in cover layer 30. Preferably, cover layer 30 is a single solid, continuous and non-porous metallic sheath of steel, titanium, or an alloy thereof.

Core layer 32 is formed from a non-isotropic (i.e. either anisotropic or quasi-isotropic) material, preferably having a reinforcement material. The reinforcement material may be in the forms of particles, flakes, whiskers, continuous or discontinuous fibers, filaments, ribbons, sheets, and the like or mixtures thereof. Suitable reinforcement material includes carbon fibers, graphite fibers, glass fibers, quartz fibers, boron fibers, ceramic fibers or whiskers such as alumina and silica, metal-coated fibers, ceramic-coated fibers, diamond-coated fibers, carbon nanotubes, aramid fibers such as Kevlar® from DuPont, extended-chain polyethylenes such as Spectra® from Honeywell, poly-p-phenylenebenzobisoxazole ("PBO") fibers such as Zylon® from Toyobo, metal fibers, polythenes, polyarylates, polyacetals, liquid crystalline polymers, aromatic polyesters such as Vectran® from Celanese, polyallylates, other high performance fibers, and combinations thereof. Metal-coated fibers may be any of the above fibers coated with a metal such as titanium, nickel, copper, cobalt, gold, silver, lead, etc. The reinforcement material is impregnated with thermosetting or thermoplastic resins, serving as the matrix binder and providing vibration damping effect to shaft 12. Suitable resins include epoxy; polyester; polystyrene; polyurethane; polyurea; polycarbonate; polyamide; polyimide; polyethylene; polypropylene; polyether; polyvinyl halide; polyvinylidene halide; nylon, nylon 6, polyphenylene sulfide ("PPS"), polyether ether ketone, polyether ketone ketone, polyamide imide, polyether imide, polyaryl sulfone, polyether sulfone, liquid crystal polymer, and the like or mixtures thereof. As is well known in the art, these resins may further include modifying agents such as hardeners, catalysts, fillers, crosslinkers, and the like. Preferably, the reinforcement materials is present in core layer 32 at a volume percentage of from about 10% to about 80%, and at a weight percentage of from about 5% to about 90%. More preferably, the volume percentage is from about 30% to about 70%, and the weight percentage is from about 20% to about 75%. In the preferred embodiment, core layer 32 is formed from epoxy-impregnated carbon or graphite fibers. Commercial sources of resin pre-impregnated carbon or graphite fibers are well known in the industry.

Thickness of shaft 12 depend on specific characteristics desirable from the shaft, as well as the particular club head 18 used, and may vary from one portion of the shaft to another, but should be in a range of between about 0.01 inches and about 0.5 inches. In one embodiment, cover layer 30 preferably has a thickness of less than about 0.2 inches, more preferably from about 0.001 inches to about 0.15 inches, and most preferably from about 0.01 inches to about 0.12 inches. Core layer 32 should have a thickness of less than about 0.3 inches, preferably less than about 0.25 inches, more preferably from about 0.001 inches to about 0.2 inches, and most preferably from about 0.01 inches to about 0.18 inches. In another embodiment, a volume ratio of core layer 32 to cover layer 30 is preferably less than about 20:1, more preferably less than about 15:1, and most preferably less than about 10:1. Furthermore, the thickness of each layer may be non-uniformed and vary depending upon the location along the shaft. For example, cover layer 30 and/or core layer 32 may be thicker at the butt portion 14 and/or thinner at the tip portion 16. In general, at any point along the shaft, a ratio of wall thickness between cover layer 30 and core layer 32 ranges from about 5:95 to about 90:10, more preferably from about 10:90 to about 70:30, and most preferably from about 20:80 to about 50:50. Weight of cover layer 30 is preferably less than about 80 grams, more preferably from about 1 gram to about 60 grams, and most preferably from about 10 grams to about 50 grams. Weight of core layer 32 is preferably less than about 100 grams, more preferably from about 1 gram to about 80 grams, and most preferably from about 10 grams to about 70 grams. Overall weight of shaft 12 is preferably less than about 130 grams, more preferably less than about 110 grams, and most preferably less than about 95 grams.

Advantageously, the isotropic material of cover layer 30 increases the shaft torque resistance (i.e. torsional stiffness). Cover layer 30 reinforces shaft 12, particularly the tip portion 16, to prevent club head 18 from twisting around the shaft's longitudinal axis during impact, thereby keeping the ball flight straight. Cover layer 30 also improves shaft 12 in its resistances to breakage at the tip portion 16 and to abrasion and weathering, as well as improves esthetic appearance of the shaft 12, and facilitates the coupling between shaft 12 and club head 18. The non-isotropic composite material of core layer 32 reduces the overall weight of the shaft 12, and enhances its bending and flexion characteristics. In the preferred embodiment, substantially all of the reinforcement materials such as carbon or graphite fibers within core layer 32 are aligned at about 0° with respect to the shaft axis (i.e., longitudinally along the shaft, or parallel to the length of the shaft), so that the longitudinal stiffness of core layer 32 is greater than its transverse stiffness. With this configuration, core layer 32 controls majority of the flexural stiffness (i.e. bending resistance) of the shaft 12. Bending stiffness ranging from L to X can be achieved simply by incrementally incorporating 0° fibers in the core layer 32. Preferably, cover layer 30 and/or core layer 32 extend the entire tip portion 16 and middle portion of the shaft 12, and more preferably extend substantially the entire length of the shaft 12. In an alternative embodiment, between about 5 weight percent and about 90 weight percent of the reinforcement material may be aligned preferably at an angle of from about 10° to about 170° with respect to the shaft axis. More preferably, the alignment angle is from about 30° to about 150°, and most preferably, from about 45° to about 135°. In another embodiment, alternating layers of fiber-reinforced composite material having fiber alignment angles of about 45°, 0° and 135° are stacked together to form core layer 32. Preferably the amount of 45° fibers and the amount of 135° fibers are substantially the same. Optionally certain portions of the shaft 12 may be further strengthened by fiber-reinforced composite material having a fiber alignment angle of about 90°.

By virtue of its material composition, core layer 32 can reduce vibration transmission along the shaft 12, diminish acoustic noise generation upon impact between the club head 18 and the ball, and improve the feel of the club 10. The thermosetting or thermoplastic resins of core layer 32 as described above provide a certain level of vibration damping to the shaft 12. Preferably, the thermosetting or thermoplastic resin of core layer 32 has a loss factor of from about 0.2 to about 1.2 at 100 Hz and 68° F., a shear storage modulus of at least about 1,000 psi, and a Young's modulus of at least about 0.01 Mpsi. The Young's modulus of the isotropic material of cover layer 30 should be at least about one order of magnitude greater than that of resin in core layer 32. Core layer 32 may be formed by any conventional methods used to manufacture composite (graphite) shafts, including sheet or ply rolling, filament winding, multiaxial braiding, ply stacking and rolling, etc. These and other methods appropriate for the fabrication of core layer 32 are well known to one of ordinary skill in the art.

Figure 5:
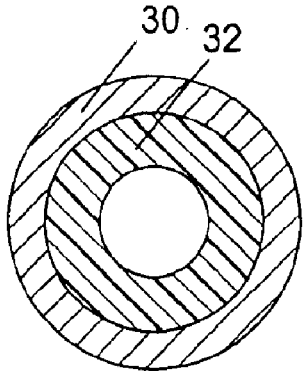
FIGS. 5–10 are cross-sectional views of multi-layer golf shafts according to the present invention.
Figure 6:
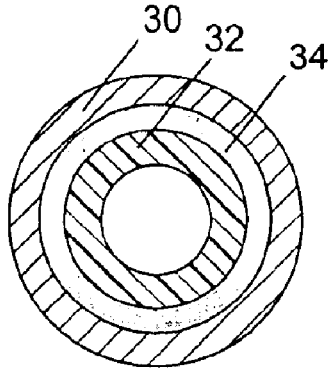

FIGS. 5–8 illustrate the cross-sections of different embodiments of the golf club shaft 12 of the present invention. FIG. 5 depicts the basic dual-layer design having cover layer 30 encircling core layer 32. Shown in FIG. 6, an optional vibration damping layer 34 comprising a viscoelastic material is disposed between cover layer 30 and core layer 32. The viscoelastic material is capable of dissipating vibration energy by converting it into heat. Preferably, the viscoelastic material has a shear storage modulus of at least about 10 psi and a loss factor of at least about 0.01 at a temperature range of −40° C. to 100° C. and a frequency range of 1 Hz to 10,000 Hz. The viscoelastic material preferably has a Young's modulus of at least about 15 psi, and is less than that of the isotropic material of cover layer 30 by at least about one order of magnitude, preferably by at least about three orders of magnitude. Also preferred, the viscoelastic material has a strain energy ratio of at least about 2%.

Vibration damping layer 34 may be a continuous layer, a discontinuous layer, a layer of uniformed or non-uniformed thickness, a lattice network layer, a wound layer, a woven or braided layer, or a laminar layer. The viscoelastic material of vibration damping layer 34 may optionally have adhesive properties, be crosslinked, and further comprise additives such as fibrous and/or particulate materials, curing agents, crosslinking agents, fillers, colorants, processing aids, antioxidants, foaming agents, and mixtures thereof. Specific viscoelastic materials for the present invention include, but are not limited to, vinyl copolymers; polyvinyl acetate and copolymers thereof; acrylics; polyesters; polyurethanes; polyethers; polyamides; polybutadienes; polystyrenes; polyisoprenes; polyethylenes; polyolefins; polyvinyl butyral; styrene/isoprene block copolymers; metallized polyesters; metallized acrylics; epoxies; epoxy and graphite composites; epoxy-acrylate interpenetrating networks; natural and synthetic rubbers; silicon rubbers; nitrile rubbers; butyl rubbers; styrene-butadiene copolymers; piezoelectric ceramics; thermosetting and thermoplastic rubbers; foamed polymers; ionomers; low-density fiber glass; bitumen; air bladders; liquid bladders; and mixtures thereof. The metallized polyesters and acrylics preferably comprise aluminum as the metal. Piezoelectric ceramics particularly allow for specific vibration frequencies to be targeted and selectively damped electronically. Examples of additives and alternative configurations of vibration damping layer 34 are described in U.S. Pat. No. 5,902,656, the disclosure of which is incorporated herein by reference in its entirety. Commercially available viscoelastic materials applicable in the present invention include resilient polymeric materials such as Scotchdamp™ from 3M, Sorbothane® D from Sorbothane, Inc., DYAD® and GP® from Soundcoat Company Inc., Dynamat® from Dynamat Control of North America, Inc., NoViFlex™ Sylomer® (from Pole Star Maritime Group, LLC, and Legetolex™ from Piqua Technologies, Inc.

Another group of suitable viscoelastic materials is low-density granular materials that when coupled to structures for the purpose of reducing structural vibrations, provide a concomitant attenuation in airborne acoustic noises radiated from the structure. Such low-density granular materials include without limitation perlite; vermiculite; polyethylene beads; glass microspheres; expanded polystyrene; nylon flock; ceramics; polymeric elastomers; rubbers; dendritic particles; and mixtures thereof. Preferably, low-density granular materials with dendritic structures and low bulk sound speeds are used for vibration damping layer 34 to maximize damping of low-frequency vibrations and attenuating acoustic noises in golf shafts. Technology associated with the use of these low-density granular materials for damping structural vibrations is described by the trademark name Lodengraf™.

Other choices of materials for vibration damping layer 34 are within the knowledge of one skilled in the art of vibration damping. Vibration damping layer 34 preferably has a thickness of less than about 0.1 inches, more preferably from about 0.0005 inches to about 0.05 inches, and is typically no thicker than cover layer 30 or core layer 32. The thickness of vibration damping layer 34 may be constant or it may vary along the shaft 12. For example, vibration damping layer 34 may be thicker in the butt portion 14 and thinner in the tip portion 16. Vibration damping layer 34 may be placed only in specific regions along the shaft 12, preferably only in the butt portion 14, or cover the entire length of the shaft 12 to prevent propagation of vibrations and shocks. In a preferred embodiment, vibration damping layer 34 comprises a thermosetting or thermoplastic resin identical to the resin in core layer 32. Vibration damping layer 34 preferably covers at least about 5% of the entire length of the shaft, more preferably from about 25% to about 100%, and most preferably from about 50% to about 100%.

Figure 7:
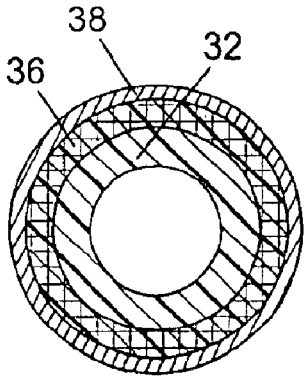

In an alternative embodiment of the present invention, as illustrated in FIG. 7, an intermediate member 36 and an outer layer 38 in combination may replace cover layer 30 of FIG. 5. Intermediate member 36 juxtaposes both core layer 32 and outer layer 38, and preferably is a porous grid, web, mesh, cloth, woven member, braided member, wound member, coil member, continuous member, discontinuous member, or lattice network member formed of an isotropic material, preferably metallic fibers, filaments, wires, strips, or ribbons. Intermediate member 36 may further comprise any of the reinforcement material described above. Any of these filaments and/or fibers may be arranged at different angles with respect to the longitudinal axis of shaft 12. Preferably, isotropic (metallic) fibers and non-isotropic reinforcement fibers are meshed or inter-woven together. To provide shaft 12 with sufficient stiffness, intermediate layer 36 comprises at least about 50 weight percent of an isotropic or non-isotropic material having a Yong's modulus of greater than about 10 Mpsi. Intermediate layer 36 is preferably embedded within core layer 32, so that the outer surfaces of the two are flush with each other. In one embodiment, intermediate member 36 has a thickness of preferably less than about 0.2 inches, more preferably between about 0.001 inches and about 0.15 inches. Thickness of intermediate member 36 is also preferred to be less than that of core layer 32, so that it is partially or fully embedded in the outer surface of core layer 32. Alternatively, thickness of intermediate member 36 may be greater than or equal to that of core layer 32, and no less than about 0.2 inches. By integrating, or "fusing," intermediate member 36 with core layer 32, torsional rigidity of the shaft 12 is significantly enhanced, yet bending stiffness of shaft 12 is only marginally affected. Bending stiffness, as mentioned before, can be modified by incorporating appropriate amounts of 0° reinforcement fibers into core layer 32.

Figure 8:
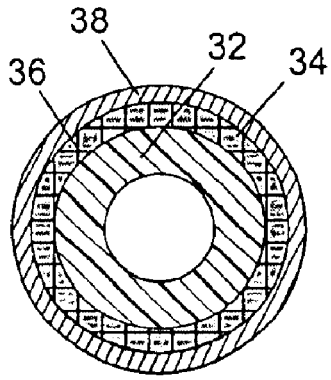

Suitable isotropic materials for intermediate member 36 include metals such as titanium, steel, stainless steel, aluminum, tungsten, nickel, copper, zinc, chromium, brass, bronze, magnesium, tin, gold, silver, and the like or alloys thereof. Other useful materials for intermediate member 36 include quasi-isotropic metallic matrix composites. Intermediate member 36 may be applied in any portions of the shaft as a continuous or discontinuous layer having uniformed or non-uniformed thickness. Preferably, intermediate member 36 covers at least the tip portion 16 of the shaft 12 where torsional rigidity is most demanded and desired. The tip portion 16 typically is about 2 inches to about 10 inches in length, measured from the lower tip end upward along the shaft 12. Overall, intermediate member 36 covers at least about 5% of the length of the shaft 12, more preferably at least about 75%, and most preferably about 100%. In one embodiment, intermediate member 36 and vibration damping layer 34 may be used together in a multi-layer hybrid shaft, as shown in FIG. 8. Vibration damping layer 34 may juxtapose both core layer 32 and outer layer 38. Intermediate member 36 is preferably integrated with, or embedded within, vibration damping layer 34, having a thickness of no greater than vibration damping layer 34. Intermediate member 36 and vibration damping layer 34 may be substantially coextensive and have substantially the same thickness, in which case they are combined to form a single hybrid layer that provide both structural strength and vibration damping to the shaft 12.

In the presence of intermediate member 36, as in FIGS. 7 and 8, it is preferred to cover the entire shaft 12 with an outer layer 38 of an isotropic material for added durability and aesthetic appeal. Suitable isotropic materials for outer layer 38 are metals, preferably the same metal used to form intermediate member 36, and comprises titanium, steel, stainless steel, aluminum, tungsten, nickel, copper, zinc, chromium, brass, bronze, magnesium, tin, gold, silver, and the like or alloys thereof. Preferably, outer layer 38 has a thickness of less than about 0.05 inches, more preferably between about 0.0004 inches and about 0.03 inches, and most preferably between about 0.001 inches and about 0.02 inches. Conventional methods for metal polishing may be used in fabricating outer layer 38, as detailed below.

Figure 9:
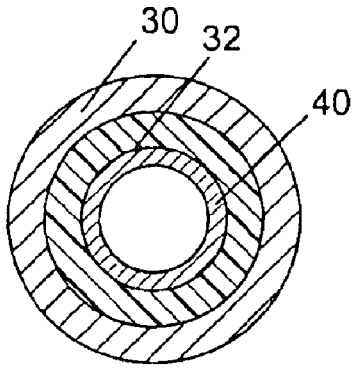
Figure 10:
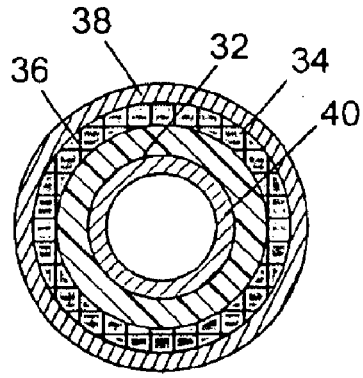

Furthermore, a reinforcing layer 40 formed from an isotropic or quasi-isotropic material may be disposed on the inner surface of core layer 32, as illustrated in FIGS. 9 and 10. Such configurations sandwich core layer 32 between reinforcing layer 40 on the inside and cover layer 30 (FIG. 9) or the combination of intermediate member 36 and outer layer 38 (FIG. 10), forming a classic strained layer vibration damping system that effectively dissipate mechanical energy in the shaft 12 resulted from striking. Reinforcing layer 40 may be continuous or discontinuous, porous or nonporous, similar in construction and/or material composition to cover layer 30 or intermediate member 36, with a thickness of preferably less than about 0.1 inches, more preferably from about 0.001 inches to about 0.05 inches. Alternatively, reinforcing layer 40 may be one or more discrete elements placed at predetermined locations on the shaft 12 to achieve certain objectives, such as weight adjustment, structural reinforcement, stiffness modification, or kick point adjustment, among others. Reinforcing layer 40 preferably covers a length of at least about 5% of shaft 12, more preferably it is coextensive to core layer 32 and/or cover layer 30. Materials suitable for reinforcing layer 40 include those described above for cover layer 30 and intermediate member 36.

Shaft 12 of the present invention is typically produced in a two-stage process. First, cover layer 30 is pre-formed using conventional methods known to one of ordinary skill in the art, including sheet welding, cold drawing and extrusion. Preferably, cover layer 30 is produced and then air hardened for extra strength using methods described in U.S. Pat. No. 6,293,313. Cover layer 30 may further be coated with one or more metallic elements using any of the metal polishing and deposition methods disclosed below, or coated with one or more non-metallic materials as finishing layers. Certain dimensions of the shaft 12, including overall length and outer diameters of the butt portion 14 and the tip portion 16, as well as its general shape (tapered or stepped) are determined by cover layer 30.

Figure 11:
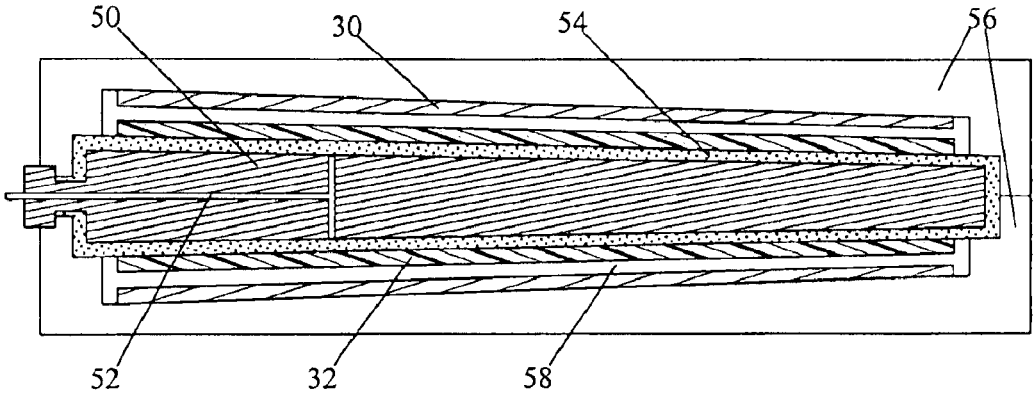
FIGS. 11 and 12 are longitudinal sectional views of a bladder mold for the production of a multi-layer golf shaft.

In the second stage, core layer 32 is typically bladder-molded directly onto the inner surface of cover layer 30. Specifically, as depicted in FIG. 11, a metal mandrel 50 is provided, which has a length slightly greater than that of the shaft 12, and a profile substantially tapered uniformly. A channel network 52 is fabricated within the mandrel 50 to connect multiple openings on the surface of mandrel 50 to an external fluid or gas source (not shown). The mandrel 50 is covered with a bladder 54 made out of a stretchable and impervious material, such as rubber or latex. The thin bladder 54 in the shape of the mandrel 50 may be formed by dipping a counter-form of the mandrel 50 in a liquid bath of latex or similar material. This produces a bladder 54 which fits the mandrel 50 perfectly, and avoids folds and other surface defects. Alternatively, as described in U.S. Pat. No. 6,361,840, the bladder 54 may be formed by injection molding, which allows the bladder wall to have variable thickness, thereby enabling core layer 32 to have variable wall thickness and complex interior profile, or allowing core layer 32 to conform to inner contours of cover layer 30. Plus, the injection-molded bladder 54 has added advantages of withstanding high compaction pressures, being durable and reusable and therefore cost-effective, and being easy to remove.

Bladder 54 is preferably comprised of an elastomeric, heat-resistant material. Bladder 54 is required to expand but very little when the bladder is pressurized to compress core layer 32 against cover layer 30, and it must also be stretched and removed from the interior of the finished cured part. Resilient and flexible materials that are suitable to form bladder 54 include, without limitation, silicon rubber, neoprene, polyvinyl chloride, polyurethane esters, polyurethane ethers, olefins, polyesters, polyethylterephthalate, elastomers, polyethylene, polypropylene, latex, thermoplastics, and mixtures thereof. Bladder 54 may be provided using conventional molding techniques such as blow molding, injection molding, rotational molding, thermoforming, vacuum-forming, thermal shrink-wrapping, or the like. It is understood by the skilled artisan that other materials and techniques known or yet unknown may be employed to produce desirable bladder 54. Bladder 54 may have a single cell or compartment, or a plurality of segregated cells or compartments that can be independently inflated or pressurized, or the multiple cells or compartments are interconnected with each other. Bladder 54 may further have surface features and/or contours such as bumps, ribs, grooves, protrusions, recesses, dimples, and the like that are in linear, helical, interleaving, spiral, scattered, lattice, wavy, or any other patterns. Varying angles and orientation of the features may result in different stiffness and stress resistance for the shaft. During the bladder molding process, these features and/or contours on bladder 54 can create complementary features and/or contours on the inner surface of core layer 32. In one embodiment, the grooves, recesses and/or dimples are filled with one or more reinforcing materials or reinforcing layer 40 disclosed herein, so that the reinforcing materials or reinforcing layer 40 can be co-molded onto or into core layer 32 in an integrated fashion. Examples of bladder 54 having groove patterns capable of molding integrated ribs on the inner surface of a tubular structure are described in International Publication No. WO 01/97990, the disclosure of which is incorporated herein by reference in its entirety.

The bladder-covered mandrel 50 is then wrapped with resin-impregnated reinforcement fibers to form core layer 32. Typically, the pre-impregnated fiber sheets ("prepregs") are draped or "laid up" over the bladder-covered mandrel 50, so that the uni-directional fibers are aligned at 0° to the longitudinal axis of the shaft 12. Plies of prepregs having fiber alignment angles of from about 30° to about 150° relative to the shaft axis are preferably used to provide additional torsional stiffness, particularly to critical areas such as the tip portion 16. Core layer 32 preferably adopts a laminar structure, having 0° prepreg plies interleaving 45° (i.e. +45°) plies and 135° (i.e. −45°) plies, as described in U.S. Pat. No. 5,569,099. Methods for forming core layer 32 in alternative to the sheet-rolling process described above include filament-winding process and braiding process. A filament-rolled shaft 12 is formed by winding fiber bundles of reinforcing fibers (yarns) over the mandrel 50 while reciprocating them along the longitudinal axis of the mandrel 50. A braided shaft 12 is formed by braiding a plurality of fiber bundles of reinforcing fibers (yarns) or tow prepregs (or yarn prepregs) over the mandrel 50 to cover substantially the entire length of the shaft 12. In manufacturing any of the shafts, the reinforcing fibers may be impregnated with thermosetting or thermoplastic resins before or after wrapping the fibers around mandrel 50. The resin of core layer 32 and/or vibration damping layer 34 may be spin-sprayed onto the inner surface of cover layer 30, or coated onto the outer surface of bladder 54 by dipping. In the case of thermosetting resins, it is critical that the resins remain uncured until the start of the bladder-molding process described below. Otherwise the cured thermosetting resin will be un-moldable. As for thermoplastic resins, they can be uncured, partially cured or fully cured prior to bladder-molding. Partially or fully cure thermoplastic resins may be softened by heat, therefore enabling the molding process.

The pre-formed cover layer 30 is placed securely in a pre-determined position in a mold 56. Cover layer 30 is secured in its position by the entire interior wall mold 56 of portion of it snuggly pressing around it, or by various clamps, holders, and the like. A pre-assembled core insert is prepared by covering mandrel 50 sequentially with bladder 54 and core layer 32, the later of which may be constructed from any combinations of prepreg plies known to one of ordinary skill in the art. The pre-assembled core insert is placed into cover layer 30. Mold 56 is then closed to hold the mandrel 50 firmly in place at one end or both ends, so that the pre-assembled core insert is substantially concentric to cover layer 30, leaving a space 58 between cover layer 30 and core layer 32. Typically the space 58 is limited to a minimum in order to lower the expansion of core layer 32 during bladder inflation and resin curing. To produce a shaft of FIG. 6, 8 or 10, a vibration damping layer 34 is further wrapped around core layer 32 on mandrel 50 as part of the pre-assembled core insert prior to placing into cover layer 30. Deposition methods for vibration damping layer 34 include sheet-rolling, filament-winding, braiding, dip coating, spin spraying, or any others known to the skilled artisan.

Figure 12:
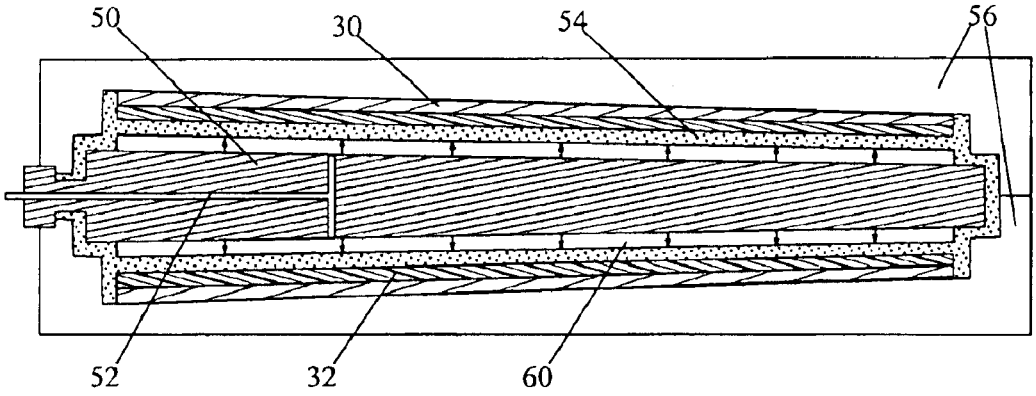

Referring to FIG. 12, core layer 32 may be molded onto the inner surface of cover layer 30 through, among other methods, bladder-molding. Specifically, heated and pressurized fluid or gas, or heat-expandable foam, bead or paste is forced into bladder 54 via channel network 52 to inflate bladder 54. Mold 56, cover layer 30 and optionally mandrel 50 are pre-heated just prior to expansion of bladder 54 and then maintained at a regulated constant temperature during the molding cycle. Bladder 54 expands progressively, pushing core layer 32 outward toward the inner surface of cover layer 30. Air in space 58 prior to molding is displaced by the outwardly moving core layer 32 and vented out through small openings on mold 56. The pressurized fluid or gas fills gap 60 left by the expanding bladder 54. When the outer surface of core layer 32 is in firm contact with the inner surface of cover layer 30, expansion of bladder 54 ceases, and the internal pressure of bladder 54 reaches a certain stable level, preferably between about 50 psi and about 300 psi. Bladder 54 is maintained at this pressure for a few minutes, allowing the heated thermosetting or thermoplastic resins in core layer 32 to cure, and then depressurized and deflated, while core layer 32 continues to be exposed to heat until at least about 90% cure is achieved. In this embodiment, cover layer 30 is preferably a solid tubular piece with or without any gaps or spaces on its inner surface. The outward movement of core layer 32, together with optional chemical treatment and/or physical roughening described below, ensures the formation of a tight bond between core layer 32 and cover layer 30. When core layer 32 is sufficiently cured, the heat is removed and hybrid shaft 12 can then be extracted out of mold 56. Variables such as duration, temperature, and pressure in each steps above depend upon, among other factors, the nature and reactivity of the resins in core layer 32, as well as the nature of the material used to form bladder 54.

The conjoining between the inner surface of cover layer 30 and the outer surface of core layer 32 during the bladder molding process above may involve structural adhesives, contact adhesion, physical bonding, chemical bonding, and the like or a combination thereof. In order to facilitate the bonding between the two layers, it may be desirable to physically and/or chemically roughen the inner surface of cover layer 30 to increase area of contact, or chemically functionalize the inner surface, through processes such as chromate treatment, phosphonation, or silanation, among others. Suitable structural adhesives for bonding between isotropic materials and non-isotropic materials of the present invention include epoxies, acrylics, acrylic/epoxy hybrids, and the like or mixtures thereof. Examples of these structural adhesives are commercially available from 3M of St. Paul, Minn. Two-part reaction-cured epoxies, one-part heat-cured epoxies, and two-part urethane adhesives are sold under the trademark of ScotchWeld™. Moisture-curing polyurethane adhesives are sold under the trademark of Jet-Weld™, double-coated pressure-sensitive all-acrylic foam tapes are sold under the trademark of VHB™, and heat-cured acrylic/epoxy hybrid structural bonding tapes are sold under the trademark of SBT™. Both VHB™ and SBT™ tapes are preferred adhesives, because their materials provide added seals against moisture and corrosion, and they can serve as a replacement for vibration damping layer 34 to diminish vibration generation and propagation in the shaft 12. Other suitable structural adhesives for the present invention are known to one of ordinary skill in the art, and include hot melts and polyvinyl acetate.

Depending on the nature of the adhesives, they can be coated or wrapped around core layer 32 during the assembly process and then co-molded onto the inner surface of cover layer 30, or they can be spin-sprayed onto the inner surface of the cover layer 30. In another embodiment, prepreg plies forming core layer 32 are directly assembled onto mandrel 50 without bladder 54, seal-wrapped with a scrim-type material, and heat-cured to form core layer 32. Then a layer of structural adhesives such as the VHB™ or SBT™ tapes is applied over core layer 32 through dip coating, spray coating, tape winding, or sheet wrapping. A volatile material such as mineral spirit can be used to coat the adhesive-covered core layer 32 for lubrication, so that core layer 32 can be easily slid into cover layer 30. Finally, the jointed cover layer 30 and core layer 32 are co-heated to evaporate off the volatile lubricant, allowing the adhesive to firmly bond cover layer 30 and core layer 32 together to form hybrid shaft 12 of the present invention.

Figure 13:
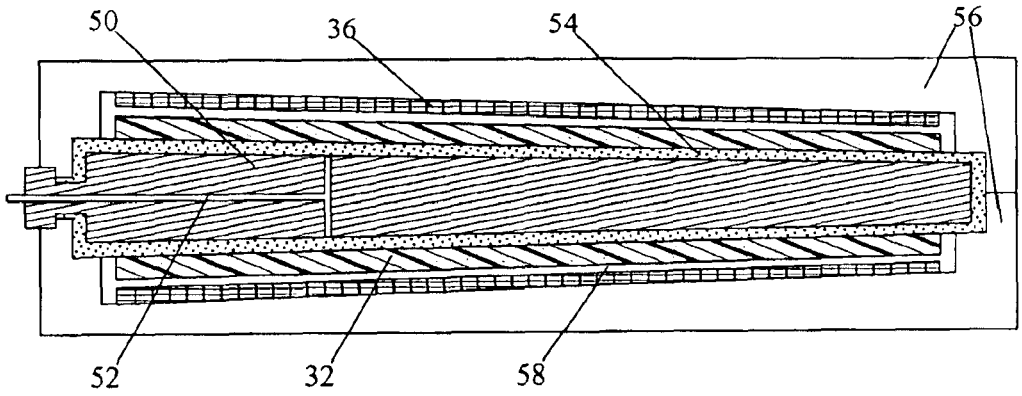
FIGS. 13 and 14 are longitudinal sectional view of another bladder mold for the production of an alternative multi-layer golf shaft.
Figure 14:
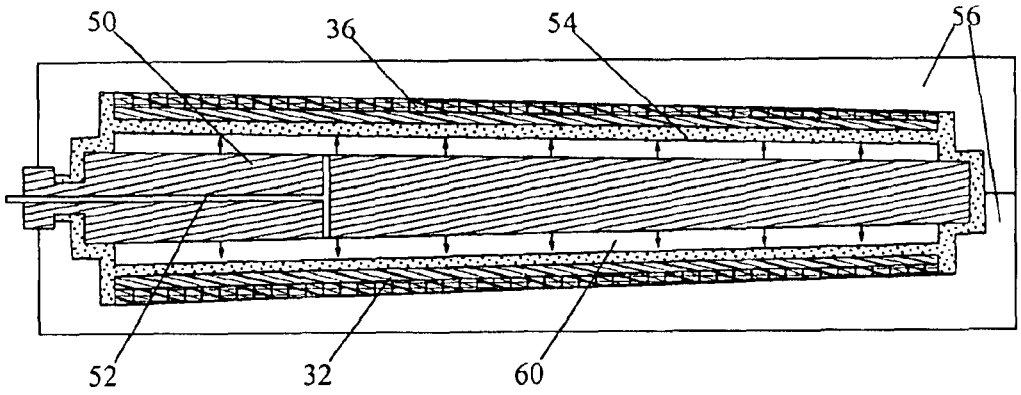

Fabrication of shafts of the present invention using a combination of intermediate member 36 and outer layer 38 as the cover layer are shown in FIGS. 13 and 14. Porous intermediate member 36 is first placed with its outer surface firmly pressed against the inner surface of mold 56 in a pre-determined position. Pre-assembled mandrel 50 covered around with bladder 54, core layer 32, optional vibration damping layer 34, and optional adhesive layer is inserted into intermediate member 36. Mold 56 closes to secure and center the mandrel pre-assembly within intermediate member 36. Bladder molding ensue, the detail of which is described above. Under the pressure of the expanding bladder 54, the material of the outer surface of the pre-assembly, may it be core layer 32, vibration damping layer 34, or optional adhesive layer, completely fills the gaps and spaces within the porous intermediate member 36. When the outer surface of the pre-assembly reaches the outer surface of intermediate member 36, it is stopped by the inner surface of mold 56. Internal pressure of bladder 54 build up to a steady level in a range of from about 100 psi to about 500 psi. As a result, intermediate member 36 is effectively embedded tightly into the resin matrix of core layer 32, with its outer surface substantially flush with that of core layer 32 to jointly form a continuous outer surface.

After core layer 32 is allowed to cure, the resulting pre-finished shaft 12 of intermediate member 36 and core layer 32 is removed from mold 56, and outer layer 38 is applied thereon. Metal coating methods for this step include, but are not limited to, thermal spraying, hot-dip galvanizing, painting, flow coating, electroless deposition, electroplating, chemical vapor deposition, physical vapor deposition, kinetic energy metallization, sputtering, ion implantation, or the like. Thickness of outer layer 38 preferably ranges from about a few layers of molecules to about 0.05 inches, more preferably from about 0.0004 inches to about 0.05 inches, and most preferably from about 0.001 inches to about 0.02 inches. Optionally, selective regions of the shaft 12, such as the tip portion 16, may be coated with a thicker outer layer 38 than other regions, thereby imparting desired properties such as extra torsional stiffness and resistance to breakage to the selected regions.

Reinforcing layer 40 may be incorporated into hybrid shaft 12 by embedding it in or depositing it on an inner surface of core layer 32 either during the construction of the pre-assembled core insert, or after core layer 32 is fully cured. In one embodiment, reinforcing layer 40 is a pre-formed, porous and expandable grid, cloth, filament wound layer, or coil layer, in which case it may be wrapped immediately around bladder 54 before lay-up of core layer 32, and co-molded into shaft 12 with core layer 32. This way reinforcing layer 40 is partially or fully embedded into the inner surface of core layer 40. In another embodiment, core layer 32 is first bladder-molded onto cover layer 30 or intermediate member 36. Reinforcing layer 40 is then formed by depositing one or more metal element on the inner surface of core layer 32 using any of the methods mentioned above for fabrication outer layer 38. In an alternative embodiment, reinforcing layer 40 is a solid sheath, a discontinuous layer, or a lattice network layer wrapped directly on mandrel 50. Core layer 32 and optional vibration damping layer 34 are laid up on reinforcing layer 40 to form a pre-assembled core insert. The core insert is wrapped with a scrim-type layer and fully cured in an oven as a typical composite shaft. Then the cured core insert is coated with a layer of structural adhesive, lubricated with mineral spirit, and placed snuggly into cover layer 30. Heat is applied to evaporate off the mineral spirit so that the adhesive bonds the cured insert to cover layer 30 to yield hybrid shaft 12.

After shaft 12 is molded and optionally coated with outer layer 38, certain cosmetic steps such as finishing, painting and varnishing are performed. Desirably, any burrs of resin located along the mold joint are removed by grinding or other methods. Painting can be followed by a post-curing operation, which entails heating shaft 12 at a temperature of between about 80° C. and about 180° C. for approximately 25 minutes to 2 hours. This step completes the curing of shaft 12 and releases the volatile organic compounds and hazardous air pollutants from within core layer 32.

Any of the layers disclosed herein for hybrid shaft 12 may further include one or more layers to achieve certain functions or properties. For example, cover layer 30 may be coated with one or more metallic or non-metallic layers for enhanced appearance or weather-proofing. Core layer 32 may include multiple plies of prepreg having reinforcement fibers aligned at different angles to the shaft axis for added strength and/or stiffness. Shaft 12 may further incorporate one or more decorative layers to enhance aesthetics, such as those disclosed in U.S. Pat. No. 5,773,154.

All patents and patent applications cited in the foregoing text are expressly incorporated herein by reference in their entirety.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A hollow golf club shaft of circular cross section comprising at least one tubular cover layer comprising at least one isotropic material, and at least one tubular core layer comprising at least one reinforcement material chosen from carbon fibers, graphite fibers, glass fibers, quartz fibers, boron fibers, ceramic fibers, ceramic whiskers, metal-coated fibers, ceramic-coated fibers, diamond-coated fibers, carbon nanotubes, extended-chain polyethylenes, poly-p-phenylenebenzobisoxazole fibers, metal fibers, polythenes, polyarylates, polyacetals, liquid crystalline polymers, aromatic polyesters, and polyallylates, the reinforcement material being impregnated with at least one vibration damping thermosetting or thermoplastic resin chosen from epoxy, polyester, polystyrene, polyurethane, polyurea, polycarbonate, polyamide, polyimide, polyethylene, polypropylene, polyether, polyvinyl halide, polyvinylidene halide, nylon, nylon 6, polyphenylene sulfide, polyether ether ketone, polyether ketone ketone, polyamide imide, polyether imide, polyaryl sulfone, polyether sulfone, and liquid crystal polymer, wherein the vibration dampening thermosetting or thermoplastic resin has a loss factor of between about 0.2 and about 1.2 at 100 Hz and 68° F., a storage modulus of at least about 1,000 psi, and a Young's modulus of at least about 0.01 Mpsi, the cover layer and the core layer are conjoined and coextend substantially the entire length of the shaft, and the cover layer at an upper butt portion has a thickness of 0.001 inches to about 0.2 inches.

2. The shaft of claim 1, wherein the isotropic material of the cover layer comprises metal matrix composites, metals and alloys thereof comprising titanium, steel, stainless steel, aluminum, tungsten, nickel, copper, zinc, brass, bronze, magnesium, tin, gold, or silver.

3. The shaft of claim 1, wherein substantially all of the reinforcement material is aligned longitudinally along the shaft.

4. The shaft of claim 1, wherein the non-isotropic material is epoxy-impregnated carbon or graphite fibers, and wherein the carbon or graphite fibers are present in an amount of from about 10% to about 80% by volume of the core layer.

5. The shaft of claim 1, wherein the cover layer at the upper butt portion has a thickness of about 0.01 inches to about 0.15 inches.

6. The shaft of claim 1, wherein the cover layer has a weight of about 10 grams to about 80 grams.

7. The shaft of claim 1, wherein the isotropic material has a first Young's modulus of at least about 5 Mpsi.

8. The shaft of claim 7, wherein the resin has a second Young's modulus less than the first Young's modulus by at least about one order of magnitude.

9. The shaft of claim 7, wherein a volume ratio of the core layer to the cover layer is less than about 20:1.

10. The shaft of claim 1, wherein at least one location on the shaft has a thickness ratio of the cover layer to the core layer between about 5:95 and about 90:80.

11. The shaft of claim 1, wherein at least one location along the shaft has a thickness ratio of the cover layer to the core layer ranging from about 5:95 to about 90:10.

12. The shaft of claim 1, wherein an outer surface of the core layer is conjoined to an inner surface of the cover layer through structural adhesives, contact adhesion, physical bonding, or chemical bonding.

13. The shaft of claim 1, wherein an outer surface of the core layer is conjoined to an inner surface of the cover layer through structural adhesives comprising one-part heat-cured epoxies, two-part reaction-cured epoxies, two-part reaction-cured polyurethanes, acrylics, double-coated bonding tapes, pressure-sensitive adhesives, or heat-cured epoxy/acrylic hybrid adhesives.

14. The shall of claim 1, wherein the cover layer at the upper butt portion has a thickness of about 0.12 inches to about 0.2 inches.

15. The shaft of claim 1, wherein at least one location on the core layer has a thickness of less than about 0.3 inches.

16. The shaft of claim 1, wherein at least one location on the core layer has a thickness of about 0.18 inches to about 0.3 inches.

17. The shaft of claim 1, wherein a volume ratio of the core layer to the cover layer is less than about 20:1.

18. The shaft of claim 1, wherein the cover layer at the upper butt portion has a thickness of about 0.001 inches to about 0.12 inches, and the core layer at one location has a thickness of about 0.001 inches to about 0.18 inches.

19. The shaft of claim 1, wherein the shaft has an upper butt portion and a lower tip portion, and wherein the cover layer at the butt portion is different in thickness than the cover layer at the tip portion.

20. The shaft of claim 19, wherein the cover layer at the butt portion is thicker than the cover layer at the tip portion.

* * * * *